United States Patent [19]

Hoffman

[11] 4,091,491

[45] May 30, 1978

[54] SKIN CARE MITT

[76] Inventor: Sara M. Hoffman, 22431 Michale St., Canoga Park, Calif. 91304

[21] Appl. No.: 713,375

[22] Filed: Aug. 11, 1976

[51] Int. Cl.[2] ..... A47K 7/02

[52] U.S. Cl. ..... 15/227; 128/62 R

[58] Field of Search ..... 15/104.94, 227; 2/158, 2/159, 161 R; 401/27; 128/62 R, 67

[56] References Cited

U.S. PATENT DOCUMENTS

| | | | |
|---|---|---|---|
| 548,541 | 10/1895 | Heafield | 2/159 |
| 573,579 | 12/1896 | Donahoo | 15/222 X |
| 1,475,221 | 11/1923 | Cleveland | 2/161 R UX |
| 1,481,772 | 1/1924 | Zell | 15/227 X |
| 1,941,320 | 12/1933 | Pamplin | 15/227 UX |
| 2,083,935 | 6/1937 | Arnold | 2/159 UX |
| 2,875,461 | 3/1959 | Anderson | 15/227 X |
| 2,905,946 | 9/1959 | Goldsmith | 2/158 |

FOREIGN PATENT DOCUMENTS

| | | | |
|---|---|---|---|
| 748,420 | 4/1933 | France | 15/104.94 |
| 1,386,125 | 12/1964 | France | 15/227 |
| 13,460 of | 1907 | United Kingdom | 15/227 |

*Primary Examiner*—Daniel Blum

[57] ABSTRACT

A skin care device which fits over the hand of the user and which is used to clean and massage the skin when wet. It is used by rubbing the wet skin with the outer surface of the device when the user is in a bathtub of hot water or in a shower, and is always used prior to any contact by the skin with soap. The device is most effective when the proper materials are used for it's outer surface, and various raised surface preparations are found to produce improved results over a basic plain surface for the device. The raised surface serves to scrape away dead skin and dirt on the skin surface. In particular, a pre-determined pattern or random design sewn into the face of the device will substantially increase the effectiveness of the device. Alternatively, or in addition thereto, prearranged patches of a suitable material can be sewn on the face of the device so that only the strips need be of a particularly effective material, while the body of the device can be made of less expensive material. In an even further alternative embodiment, lengths of the material can be gathered and sewn to create a series of spaced folds along the device. If desired, the device can be shaped in the form of ornaments, animals, or the like. An effective design for the contour of the device is one which approaches the natural outline configuration of the human hand.

1 Claim, 7 Drawing Figures

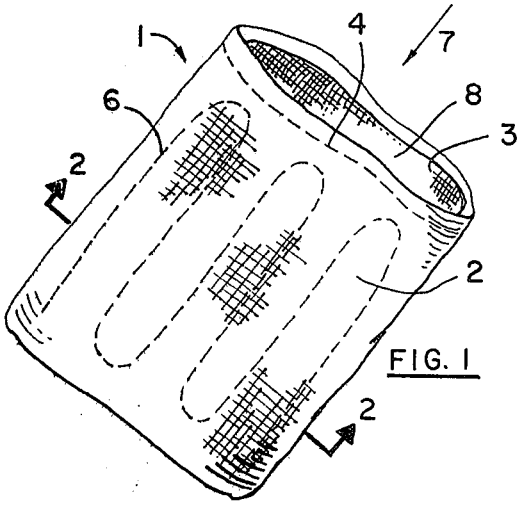
FIG. 1
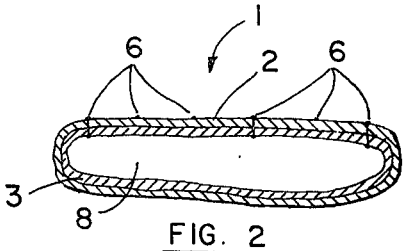
FIG. 2
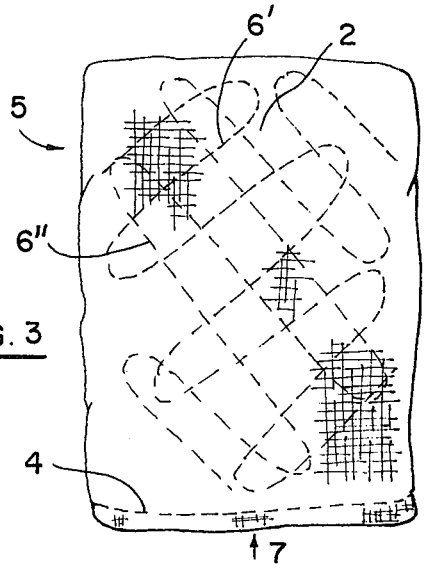
FIG. 3
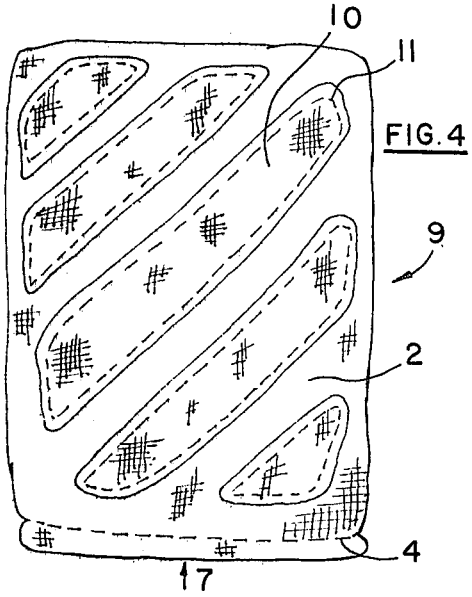
FIG. 4
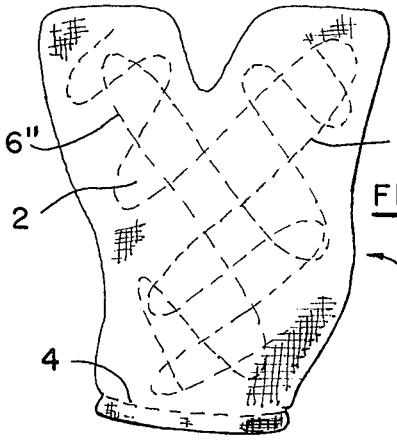
FIG. 6
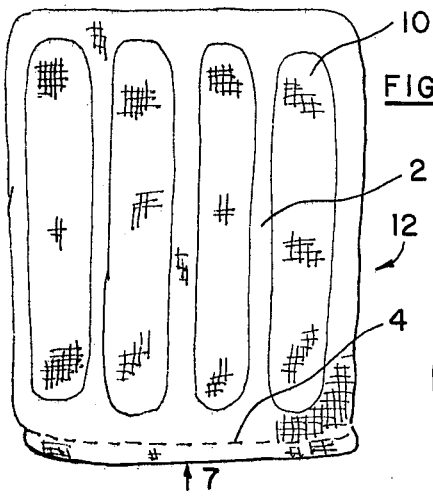
FIG. 5
FIG. 7
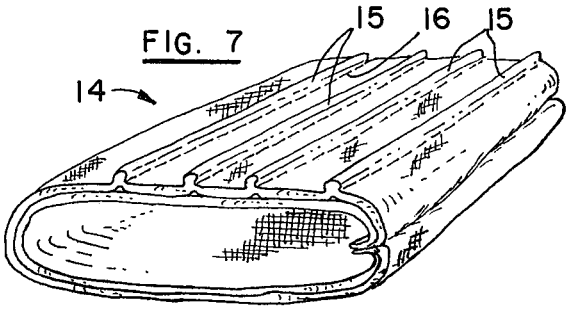

SKIN CARE MITT

BACKGROUND OF THE INVENTION

1. Field of the Invention

The field of art to which the invention pertains includes that of skin care, and in particular the cleaning of skin, the removal of dead skin, and the massaging of the skin.

2. Description of the Prior Art

Many devices are available which can be fit over the hand and used to wash the skin during bathing. However, these devices are primarily concerned with retaining soap and distributing the soap more efficiently over the body. Such devices have little, if any, advantage over the use of a normal washcloth with the exception that they are more convenient to use. Such prior art devices are generally made of a material, such as terry cloth, which simulates the material of a standard washcloth, and in particular is made of a material which easily soaks up water and liquified soap and which readily retains soft soap substances. Accordingly, the material used for such prior art devices is generally of a spongy, soft, porous nature and is designed to particularly avoid any substantial frictional contact with the skin. Such devices, while effective in distributing soap and water over a large area of the body, are ineffective in having cleaning action or scraping action by engagement with the skin, and would be totally ineffective as a device for massaging the skin.

SUMMARY OF THE INVENTION

Accordingly, it is an object of the present invention to provide a device for direct contact with the skin, which can be fit over the hand of the user, and which is effective to clean and condition the skin prior to any bathing with soap.

The invention is also useful for cleaning the skin when the convenience of a bathtub, or shower, and soap is not available, for example, when on a camping trip.

In accordance with the invention, there is provided a pocket-like mitt which fits over the hand of the user and is made of a particular material, preferably boat sail, canvas, upholstery fabric, drapery material, denim, etc., and which is frictionally engageable with the skin to remove dirt therefrom, to remove dead skin particles therefrom, and to generally soothe and massage the skin area.

The objects of the invention are met by providing a skin care device which fits over the hand of the user and which is used to clean and massage the skin when wet. It is used by rubbing the wet skin with the outer surface of the device when the user is in a bathtub of hot water or in a shower, and is always used prior to any contact by the skin with soap. The device is most effective when the proper materials are used for its outer surface, and various surface preparations are found to produce improved results over a basic plain surface for the device. The raised surface serves to scrape away dead skin and dirt on the skin surface. In particular, a pre-determined pattern or random design sewn into the face of the device will substantially increase the effectiveness of the device. Alternatively, or in addition thereto, prearranged patches of a suitable material can be sewn on the face of the device so that only the strips need be of a particularly effective material, while the body of the device can be made of less expensive material. In an even further alternative embodiment, lengths of the material can be gathered and sewn to create a series of spaced folds along the device. If desired, the device can be shaped in the form of ornaments, animals, or the like. An effective design for the contour of the device is one which approaches the natural outline configuration of the human hand. The device can also, if desired, have a rubbing surface on both sides of the mitt.

BRIEF DESCRIPTION OF THE DRAWINGS

The invention will now be described in detail with reference to the accompanying drawings representing preferred embodiments of skin care devices according to the present invention. In the drawings:

FIG. 1 is a perspective view of a first embodiment of the skin care device.

FIG. 2 is a cross sectional view of the skin care device taken along the lines 2—2 in FIG. 1.

FIGS. 3–6 show front elevational views of four different embodiments.

FIG. 7 is an end perspective view of yet a further alternative embodiment.

DESCRIPTION OF THE PREFERRED EMBODIMENTS

According to FIG. 1, there is shown a perspective view of a skin care device. The device shown in FIG. 1 is in the form of a rectangular mitt 1 having a hand opening 8 in which the hand of the user can be inserted in the direction of arrow 7. The material of the cloth outer rubbing surface 2 is selected from a particular group of preferred materials, such as boat sail, canvas, upholstery fabric, drapery material, denim, etc. For the comfort of the user, a lining 3 can be provided. The open end of the device 1, together with the open end of the lining 3 can be folded and sewn in a hem 4.

A rectangular mitt as shown in FIG. 1, made of an appropriate material, is effective to some degree for carrying out the object of this invention. It has been conclusively demonstrated, however, that the effectiveness and effeciency of the device is substantially dependent upon the provision of some form of surface preparation such as the stitching line 6 shown in FIG. 1.

When the device of FIG. 1 is used by rubbing the wet skin with the outer surface 2 of the device (prior to any soaping of the skin), three simultaneous beneficial effects of the device are realized. First, the skin is soothed by the massaging action of the device with only a gentle pressure applied to the skin. Secondly, due to the materials selected for making up the outer surface 2 of the device and due to the nature of the stitching 6 in the surface of the device, small particles of dead, dormant skin are easily removed. Finally, and again due to the special character of the selected surface material 2 and the stitching 6, dirt on the skin will form elongated dirt rolls, accumulating more dirt as the rolls are propagated along between the device and the skin. Both the removal of dead skin and the creation of dirt rolls are a direct result of the frictional engagement of the device with the treated skin area.

FIG. 2 shows a cross-sectional view of the device of FIG. 1, wherein the stitching line 6 can be seen to penetrate through the outer cloth surface 2 and through the lining 3. It is to be understood that the lining 3 is for the comfort of the user and is not an essential part of the invention, although the effectiveness of the stitching 6 to cause removal of dead skin and create dirt rolls may be improved somewhat by the padding effect of the lining 3.

FIG. 3 shows the preferred embodiment 5 of the invention wherein a criss-cross path of stitching 6 is sewn in substantially parallel lines sloping upwardly to the right, while a second pattern of stitching 6″ is shown sloping upwardly to the left. In this connection, it is important to realize that the dirt rolls created by the device are more readily produced when the motion of the device across the skin is normal to the direction of the lines of the sewn stitching 6′. Accordingly, while the device of FIG. 1 can be used effectively only by motions transverse of the direction of arrow 7, the device of FIG. 3 is not so restricted. On the contrary, if the device is moved in a reciprocating motion parallel to stitching 6′, it is automatically moving in a direction perpendicular to stitching 6″ and vice versa. Similarly, when the device is moved in a reciprocating motion normal to the direction of arrow 7, both stitchings 6′ and 6″ contribute substantially equally to creating the dirt rolls.

FIG. 4 shows a second alternative embodiment 9, wherein patch strips 10 of the preferred material are sewn in a predetermined pattern along the outer surface 2 of the device. Using the embodiment of FIG. 4, it is possible to prearrange strips or patches of a suitable material on the face of the device so that only the strips need be of the preferred effective material, while the body 2 of the device can be made of less expensive material such as cotton or flexible plastic resins. In the embodiment of FIG. 4, such patch strips 10 are shown as being angularly positioned with respect to the direction of arrow 7 and sewn in place by stitching 11.

Alternative to the embodiment shown in FIG. 4, a third alternative embodiment 12 is shown in FIG. 5 wherein patch strips 10′ are shown oriented parallel to the direction of arrow 7, but no stitching lines are seen, since the strips in this embodiment are preferably glued onto the surface 2 with an appropriate adhesive.

In FIG. 6, there is shown a fourth alternative embodiment 13 in which the device is shaped in a form which simulates the natural outline configuration of the human hand. In this embodiment, it can be appreciated that the device can fit tighter on the users hand and therefore be more convenient to use. It should be appreciated, however, that when conforming the shape of the device to the human hand, it may be necessary to provide various sizes of the device so that small children and adults can be provided with a size which fits their individual hand dimensions.

In the fifth alternative embodiment 14 as shown in FIG. 7, rather than providing stitching 6 or patch strips 10 on the surface 2 on the device, the surface preparation shown in FIG. 7 is merely a length of gathered material forming folds 15 which are permanently maintained by stitching 16. It can be appreciated that, due to the additional height of the surface preparation in the form of folds 15, the skin will realize a greater degree of frictional contact, and therefore an even better cleaning action will take place. However, the device of FIG. 7 may be damaging to a delicate skin when rubbed vigorously across the skin, so that the user may be very selective in the type of surface preparation he chooses for either his type of skin or the area of the body with which the device will contact.

From the foregoing, it can be readily realized that the device can assume various embodiments. For example, a strictly random pattern of stitching 6 might be provided on the face of the device as opposed to a predetermined pattern of relatively parallel stitching lines. Additionally, the device can be fabricated in a variety of aesthetically pleasing forms, such as in the form of animals of inanimate objects. Thus, it is to be understood that the invention is not limited to the specific embodiments described herein, but is to be limited only by the appended claim.

What I claim is:

1. A skin care device adapted to remove dead, dormant skin comprising:

a cloth mitt member having a closed end, an open end, and at least one outer rubbing surface extending therebetween; and a raised surface pattern of thread stitching distributed over a substantial portion of the area of said rubbing surface in at least one continuous path of stitching forming connected parallel lines;

said rubbing surface being of a material selected from the group consisting of boat sail, canvas, and denim said path of thread stitching forming a smooth transition at the connection of each pair of parallel lines and said raised surface pattern extending in parallel lines at approximately 45° from a line joining the centers of said ends.

* * * * *